United States Patent [19]

Lall

[11] Patent Number: 4,614,544

[45] Date of Patent: Sep. 30, 1986

[54] HIGH STRENGTH POWDER METAL PARTS

[75] Inventor: Chaman Lall, Claymont, Del.

[73] Assignee: E. I. Du Pont de Nemours and Company, Wilmington, Del.

[21] Appl. No.: 793,686

[22] Filed: Oct. 22, 1985

Related U.S. Application Data

[63] Continuation-in-part of Ser. No. 693,984, Jan. 23, 1985, abandoned.

[51] Int. Cl.[4] ..... C22C 29/00

[52] U.S. Cl. .....75/246; 75/231; 419/25; 419/26; 419/30; 419/36; 419/37; 419/38; 419/39; 419/58; 420/96; 420/119

[58] Field of Search ..... 419/25, 26, 30, 36, 419/37, 38, 39, 58; 75/123 J, 123 K, 246, 231

[56] References Cited

U.S. PATENT DOCUMENTS 4,090,874 5/1978 Kaufman ..... 419/33
4,129,443 12/1978 Kaufman ..... 419/33

*Primary Examiner*—Stephen J. Lechert, Jr.
*Attorney, Agent, or Firm*—Donald W. Huntley

[57] ABSTRACT

A high strength powder metal part formed from an alloy of iron, nickel, molybdenum and carbon and having an ultimate tensile strength of at least 175,000 pounds per square inch. The powder metal part is made by mixing the alloy with a lubricant, forming the mixture into the desired part shape, sintering in a dissociated ammonia atmosphere, and cryogenically cooling the sintered part.

8 Claims, 3 Drawing Figures

Fe – 0.5 % Mo – 0.9 % C

HIGH STRENGTH POWDER METAL PARTS

CROSS-REFERENCE TO RELATED APPLICATION

This is a continuation-in-part of copending application Ser. No. 693,984, filed Jan. 23, 1985 now abandoned.

BACKGROUND OF THE INVENTION

1. Field of the Invention

This invention relates to powder metal parts, and more particularly to a powder metal process which utilizes cryogenic treatment to improve the mechanical properties of powder metal parts.

2. Description of the Prior Art

The mechanical properties of metal parts or components manufactured by conventional powder metallurgical techniques are usually inferior to those fabricated from the same alloys by traditional wrought metallurgy. For structural applications, the most important properties are ultimate tensile strength (UTS), yield strength, elongation and impact strength. Yet these are the properties that tend to suffer from conventional powder metal processing, and are the reason powder metal parts are often not the first choice for high strength, structural applications.

Conventional powder metal parts are typically manufactured by mixing metal powders, pressing in a mold to form a compact of the desired shape, and sintering to arrive at the final product. Secondary operations may be used to improve the mechanical properties. One is heat treatment, which normally involves maintaining the part at an elevated temperature for several hours following a quench into water, oil or a gas. Because of thermally induced stresses, the part may be warmed to a moderate temperature to temper the effect of quenching. A neutral or carburizing atmosphere may be necessary for carrying out this heat treatment.

Cryogenic treatment of metal parts not made by powder metallurgy has been used for many years to harden or increase the wear resistance properties of such parts. For example, U.S. Pat. No. 3,891,477 issued June 24, 1975, to Lance et al. discloses a method of treating cast iron or steel by cryogenic cooling to improve resistance to wear and corrosion. U.S. Pat. No. 3,661,655 issued May 9, 1972, to L. J. Hrusovky describes cryogenic cooling of a spring leaf, cut from a steel blank and formed by taper rolling, to improve fatigue life and stress corrosion resistance. U.S. Pat. No. 4,336,077 issued June 22, 1982, to Leach et al. discloses cryogenically hardening a cast metal alloy insert such as a piston ring. These are but exemplary of many patents describing a variety of cryogenic treatment for metal parts not made by powder metallurgy.

More recently, it has been suggested that cryogenic treatment may be applied to powder metallurgy as an extension of the heat treatment process described earlier. The powder metal part is cryogenically cooled, not quenched, to less than minus 300° F. for several hours as described by Rick Frey in an article entitled "Cryogenic Treatment Improves Properties of Drills and P/M Parts" published in *Industrial Heating*, September 1983, pages 21–23. The article concludes that the hardness and abrasive wear resistance of heat treated, high carbon powder metal parts can be improved through cryogenic treatment. The parts examined were spurs and gears where such properties are important.

Applicant is not aware of any prior art which suggests that cryogenic treatment can improve the tensile strength of powder metal parts to the point that they can compete with wrought parts for structural uses. Applicant has discovered, however, that certain powder metal alloys, when processed in accordance with the present invention, including cryogenic treatment, will produce parts with tensile strengths of about 200,000 psi or greater.

In conventional powder metallurgy, tensile strengths of about 180,000 psi can be obtained only by heat treatment of certain iron-nickel steels. In the heat treated condition, however, these powder metal parts usually have elongation of less than 0.5% and Unnotched Charpy impact strength of less than 10 ft-lbs. Thus even though high tensile strength is obtained, the elongation and impact strength (toughness) properties suffer. The parts are very brittle and cannot sustain any appreciable stress or deformation in dynamic loading applications.

In contrast, powder metal parts made in accordance with the present invention not only have high tensile strengths of about 200,000 psi, but also have higher elongation (about 3%) and higher Unnotched Charpy impact strength (about 25 ft-lbs) making them much better suited for dynamic loading applications.

SUMMARY OF THE INVENTION

The present invention provides cryogenically treated powder metal parts formed from an alloy of iron, nickel, molybdenum and carbon and having an ultimate tensile strength of at least 175,000 pounds per square inch.

The high strength powder metal parts are made by a process comprising the steps of combining components including iron, nickel and carbon to form a powder metal alloy mixture, forming the powder metal mixture into the desired part shape with the aid of a lubricant, sintering the formed part in a dissociated ammonia atmosphere, and cryogencially cooling the sintered part.

DETAILED DESCRIPTION OF THE INVENTION

A powder metal alloy of principally iron and containing also about 10% nickel, 0.5% molybdenum and 0.8 carbon is the preferred composition. The amount of Ni, Mo and C, the atmosphere during sintering and post-sintering, and cryogenic treatment are all important in optimizing the ultimate tensile strength (UTS) and other mechanical properties. When a powder metal alloy having the preferred composition is processed in accordance with the present invention, the resulting powder metal parts will have considerably improved structural strength, with UTS approaching 200,000 psi or higher on average. In addition there is an improvement in several other mechanical properties.

A carbon content of about 0.8% is particularly unusual for an Fe-Ni system alloy. Accepted practice in metallurgy dictates that the carbon level should correspond to the eutectoid point. For a binary Fe-C system, the eutectoid composition is about 0.83% carbon in order to obtain 100% pearlite. For an Fe-10% Ni system, the eutectoid point is lower, about 0.45% carbon. If the carbon level is increased beyond the eutectoid point, too much of the carbide phase, called cementite ($Fe_3C$), will be formed which leads to the embrittlement of the powder metal part. Accordingly, one would expect the ultimate tensile strength to decrease as the carbon level exceeds the eutectoid point.

Figure 1:
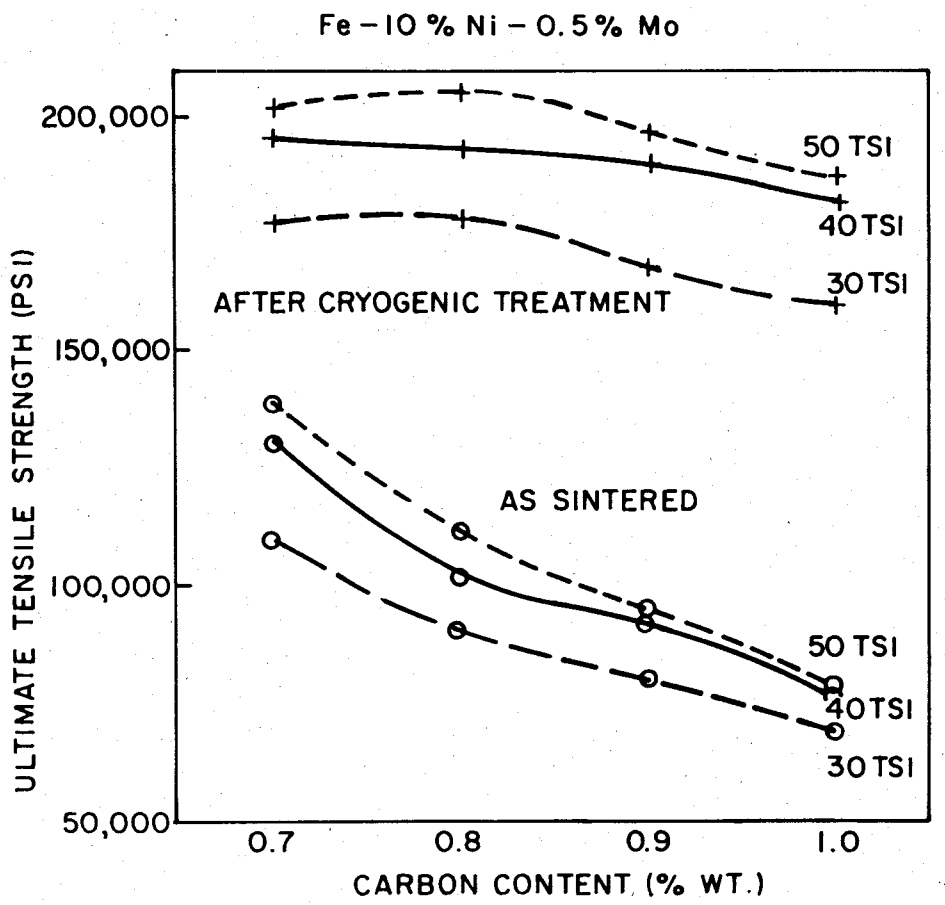
FIG. 1 is a graphical illustration of the effect of carbon content on the ultimate tensile strength of the final powder metal part, as sintered and after cryogenic treatment.

The foregoing is confirmed by FIG. 1 wherein the effect of increasing the carbon content in an Fe-10% Ni-0.5% Mo alloy system is graphically illustrated. The lower portion of FIG. 1 shows the ultimate tensile strength (UTS) values for alloys with different carbon levels which are pressed into parts at three different pressures (tons per square inch or tsi) as sintered but before cryogenic treatment. As is evident, the UTS drops drastically as carbon content is increased beyond 0.7% to 1.0%, from about 110,000–140,000 psi to less than 80,000 psi.

After cryogenic treatment, however, the results are dramatically different. As shown in the upper portion of FIG. 1, the tensile strength is improved substantially for the same alloys in the 0.7% to 1.0% carbon range, reaching a maximum of over 200,000 psi with an 0.8% carbon alloy pressed at 50 tsi.

Figure 2:
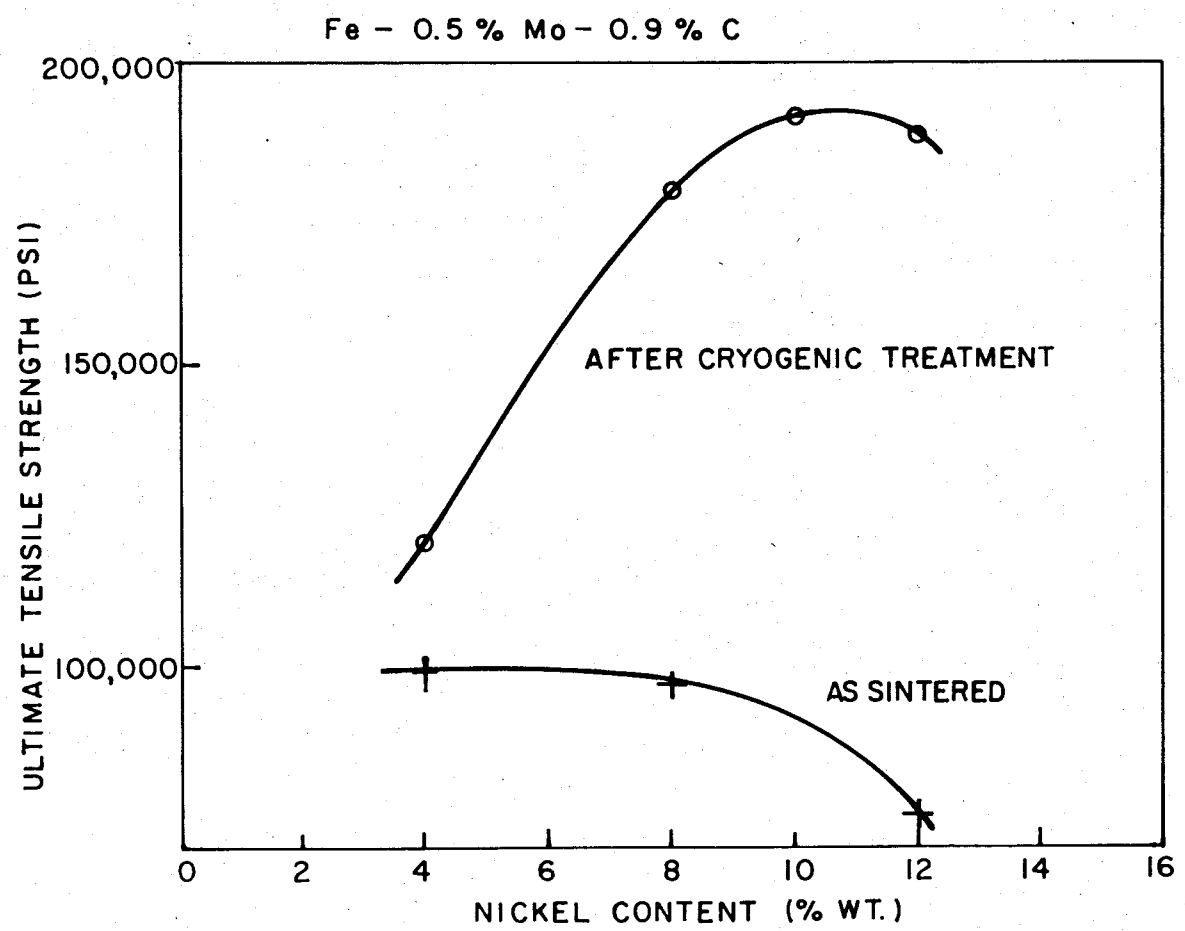
FIG. 2 is a graphical illustration of the effect of nickel content on the ultimate tensile stength of the final powder metal part, as sintered and after cryogenic treatment.

The effect of nickel content is also important and is optimum at about 10%. FIG. 2 illustrates graphically the effect on tensile strength of varying the nickel content in an Fe-0.5% Mo-0.9% C system. In the lower portion of FIG. 2, varying the nickel content from 4% to 12% results in a drop in UTS from a maximum of 100,000 psi as nickel content increases beyond about 8%. After cryogenic processing, higher nickel content has a much different effect. The tensile strength increases rapidly from about 100,000 psi at 4% nickel to a maximum of about 190,000 psi at about 10% nickel, and then begins to decrease. The results are good in the range of 8% to 12% nickel.

Figure 3:
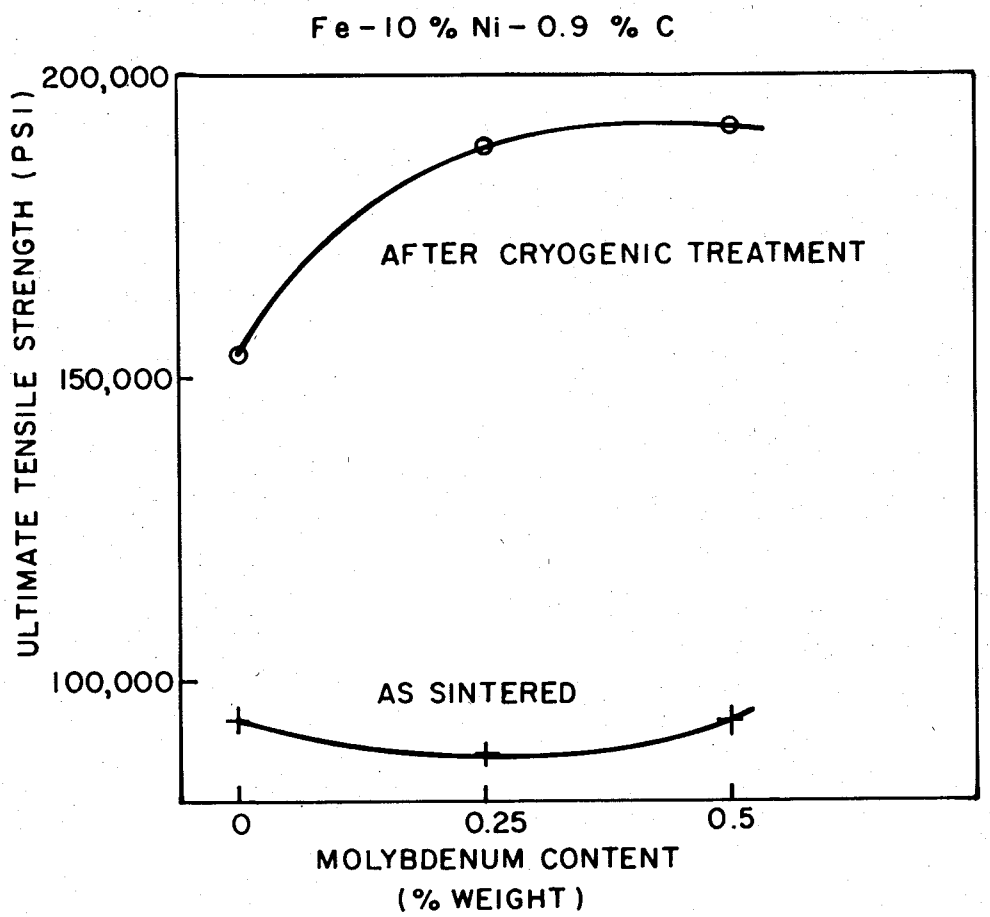
FIG. 3 is a graphical illustration of the effect of molybdenum content on the ultimate tensile strength of the final powder metal part, as sintered and after cryogenic treatment.

The molybdenum content also enhances the mechanical properties as can be seen in FIG. 3. An Fe-10% Ni-0.9% C alloy system with Mo content varying from 0% to 0.5% is illustrated. After sintering, the UTS remained below 100,000 psi as molybdenum content was varied from 0% to 0.5%. However, as shown in the upper portion of FIG. 3, increasing the molybdenum content improved tensile strength after cryogenic processing, increasing from about 150,000 psi at 0% to a maximum of about 190,000 psi at the optimum molybdenum content of 0.5%. The results were good, however, with molybdenum content as low as 0.25%, or even without any molybdenum at all.

The sintering atmosphere used is important to achieving cryogenically treated powder metal parts with optimum tensile strengths. For example, when the preferred alloy composition was sintered in vacuum, the powder metal part had an ultimate tensile strength of about 105,000 psi. After cryogenic treament, this improved to 165,000 psi. When a mixed dissociated ammonia and nitrogen atmosphere was used, the UTS value was also about 105,000 psi after sintering, but only 125,000 psi after cryogenic treatment. When a pure dissociated ammonia atmosphere is used, however, the ultimate tensile strength of the part will go from 102,000 psi after sintering to about 195,000 psi after cryogenic treatment.

After sintering, the formed parts are cryogenically cooled. The cooling can be carried out by dry processing, as described in Miller, "Cryogenics: Deep Cold Solves Heat-Treat Problems", Tooling and Production Magazine, February, 1980, hereby incorporated by reference. As described therein, the article to be treated is not dipped in liquified gas, but is slowly cooled, for example, over a period of about 15 hours, to a temperature of about from −310° F. to −320° F., maintained at that temperature for about one day, and then slowly returned to room temperature, for example, over a period of about 15 hours.

Cryogenic treatment alone will not always improve the strength of powder metal parts. Other factors influence the effect that cryogenic processing will have on the powder metal part. These include, as discussed above, the type of sintering atmosphere used and the composition of the alloy used. In the Fe-Ni alloy system, it has been shown that amounts of carbon, nickel and also molybdenum are all important in obtaining maximum benefits from cryogenic treatment.

The present invention may be further understood by reference to the following example:

EXAMPLE

A new powder metal alloy having the following composition of elements in percentage by weight is mixed with a lubricant:

| | |
|---|---|
| Carbon | 0.8% |
| Molybdenum | 0.5% |
| Nickel | 10.0% |
| Iron | balance |
| Lubricant | 0.5% Acrawax C |

The alloy mixture may be pressed at 30, 40 or 50 tsi. The part is then sintered in an atmosphere of pure dissociated ammonia for one hour at a temperature of about 2400° F. No nitrogen should be added.

Following sintering, the part is cryogenically treated by cooling gradually to a temperature of about −320° F. for several hours.

The following tables summarize the tensile strength and several other mechanical properties of the part as sintered and after cryogenic treatment:

| Tonnage (tsi) | UTS (psi) | Elongation % | Hardness (Rc) |
|---|---|---|---|
| | As Sintered | | |
| 30 | 90,000 | 2 | 37 |
| 40 | 100,000 | 2 | 30 |
| 50 | 110,000 | 2 | 31 |
| | After Cryogenic Treatment | | |
| 30 | 175,000 | 3 | 37 |
| 40 | 195,000 | 3 | 40 |
| 50 | 205,000 | 3 | 42 |

The foregoing tables demonstrate the effect of cryogenic processing when applied in the context of the present invention. In addition to achieving ultimate tensile strengths averaging on the order of 200,000 psi, and average elongation of 3% and hardness of 40 Rc, other mechanical properties include average yield stress of 135,000 psi, average impact strength of 25 ft-lbs and average Young's modulus of $20\times10^6$. The powder metal parts produced in accordance with the present invention have therefore demonstrated the properties necessary for highly stressed structural parts.

The present invention is not limited to the specific example disclosed herein, or to the particular alloy composition or process utilized. For example, while the specific alloy composition has been demonstrated to provide optimum improvement in properties, variations have also shown improvement. Thus, a carbon content of between about 0.7% to 1.0% by weight, a nickel content of between about 8% to 12% by weight and a molybdenum content of approximately 0.5% by weight, but as low as 0.25% or less (including no molybdenum at all) are all within the scope of the present invention.

It should therefore be understood that while the foregoing represents the presently preferred embodiment of the invention, variations and changes within the scope of the invention as defined by the claims may suggest themselves to those skilled in the art.

I claim:

1. A process for making a high strength powder metal part comprising the steps of combining components including iron, nickel and carbon to form a powder metal alloy mixture, forming the powder metal alloy mixture into the desired part shape with the aid of a lubricant, sintering the formed part in a dissociated ammonia atmosphere, and cryogenically cooling the sintered part.

2. A process according to claim 1 wherein the carbon content of the alloy is between about 0.7 to 1.0 percent by weight.

3. A process according to claim 2 herein the nickel content is between 8 to 12 percent by weight.

4. A process according to claim 3 wherein the alloy also includes molybdenum, the content of which is between about 0.25 percent to approximately 0.5 percent by weight.

5. A process according to claim 1 wherein the alloy composition comprises by weight 10 percent nickel, 0.8 percent carbon, 0.5 percent molybdenum and the balance iron.

6. A process according to claim 1 wherein the sintering atmosphere is pure dissociated ammonia with no nitrogen added, and the sintering temperature is about 2400° F.

7. A process according to claim 1 wherein the part is formed by pressing under pressures of between about 30 to 50 pounds per square inch and is cryogenically cooled to a temperature of about minus 320° F.

8. A powder metal part made in accordance with the process of claim 1.

* * * * *